United States Patent [19]

Shaw et al.

[11] Patent Number: 5,074,337

[45] Date of Patent: Dec. 24, 1991

[54] DUST REMOVAL DEVICE IN WEAVING MACHINES

[75] Inventors: Henry Shaw, Vleteren; Geert Geerardyn, Wijtschate; Bernard Vancayzeele, Ieper, all of Belgium

[73] Assignee: Picanol N. V., Polenlaan, Belgium

[21] Appl. No.: 592,915

[22] Filed: Oct. 4, 1990

[30] Foreign Application Priority Data

Oct. 4, 1989 [BE] Belgium ..... 8901058

[51] Int. Cl.[5] ..... D03J 1/00

[52] U.S. Cl. ..... 139/1 C; 15/345; 55/294; 139/353

[58] Field of Search ..... 15/316.1, 345; 55/294, 55/302; 139/1 C, 353

[56] References Cited

U.S. PATENT DOCUMENTS 3,805,317 4/1974 Dickinson ..... 15/316.1 X
4,237,941 12/1980 Boder ..... 139/1 C
4,397,339 8/1983 Muller ..... 139/1 C

FOREIGN PATENT DOCUMENTS 0297658 1/1989 European Pat. Off. .
1555427 1/1969 France .
483509 2/1970 Switzerland .
490549 5/1970 Switzerland .
1188108 4/1970 United Kingdom .

*Primary Examiner*—Andrew M. Falik
*Attorney, Agent, or Firm*—Bacon & thomas

[57] ABSTRACT

A device for the removal of dust from parts protecting weaving machine components from weaving dust includes a dust screen, a number of freely movable blowing tubes which direct air from their open ends into an area adjacent the dust screen, and blowing devices for feeding air through the tubes. Removed dust is disposed of by a separate device such as a suction nozzle.

24 Claims, 5 Drawing Sheets

Fig. 1
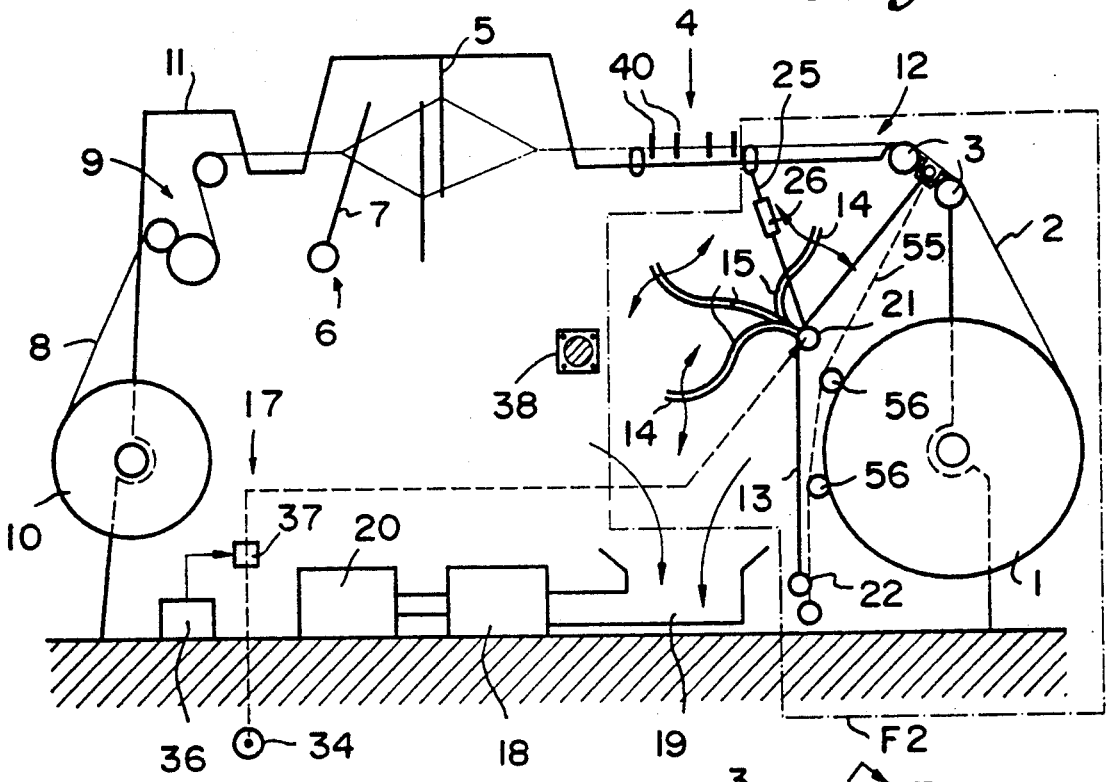
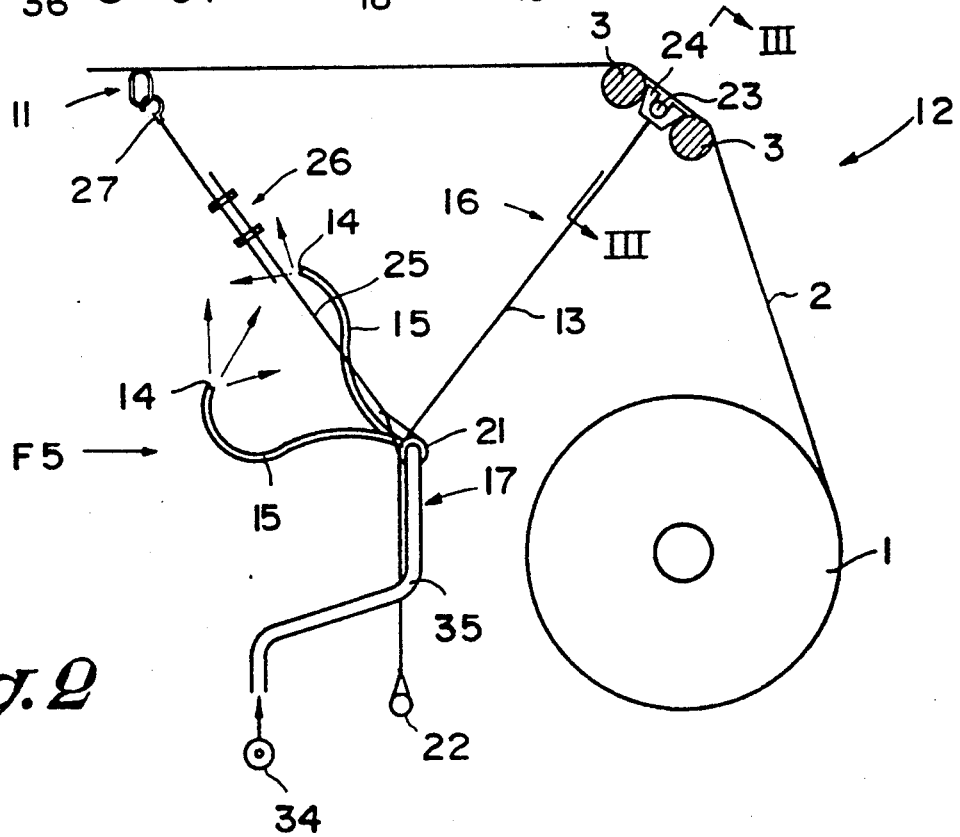
Fig. 2

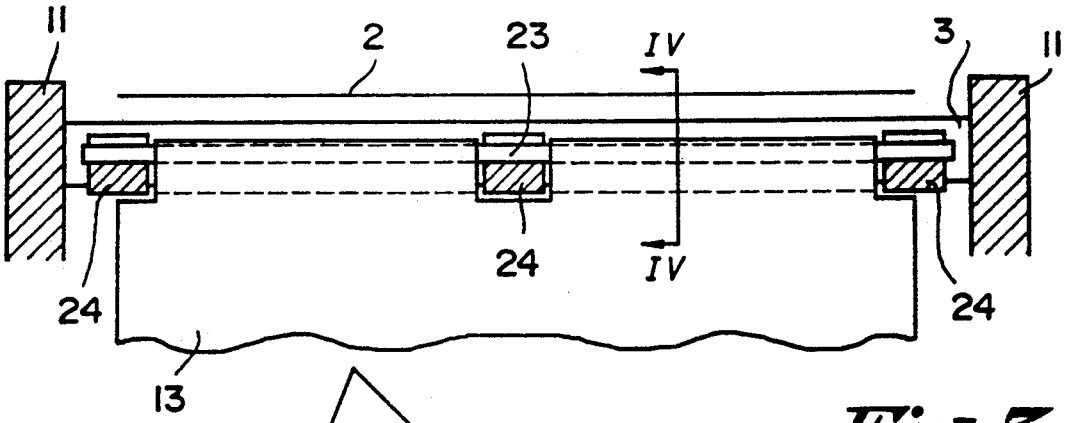
Fig. 3
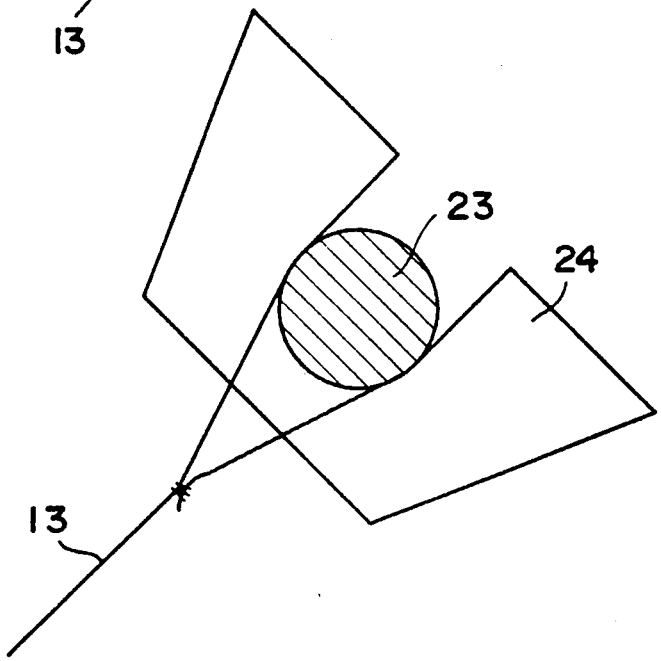
Fig. 4
Fig. 5
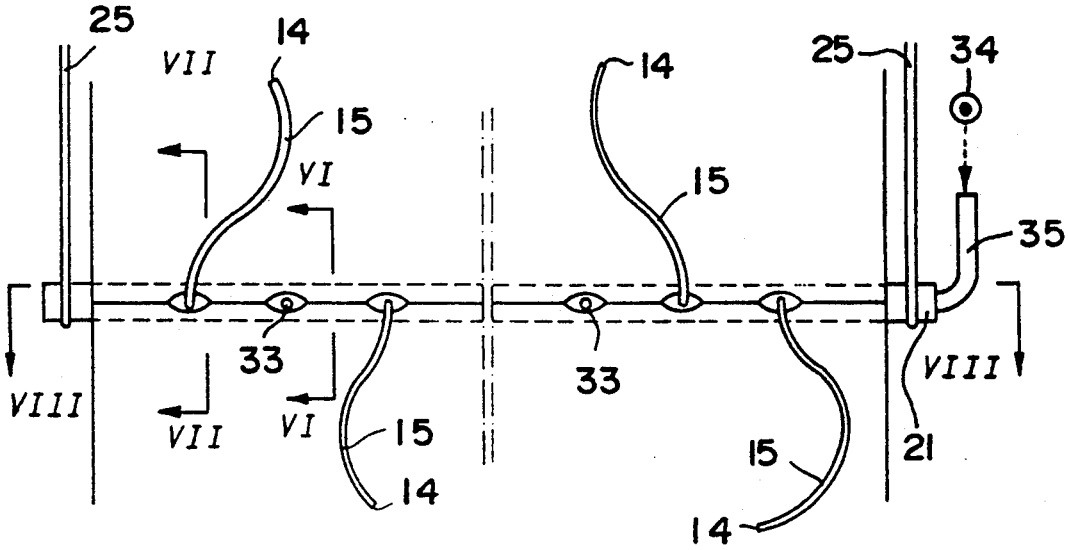

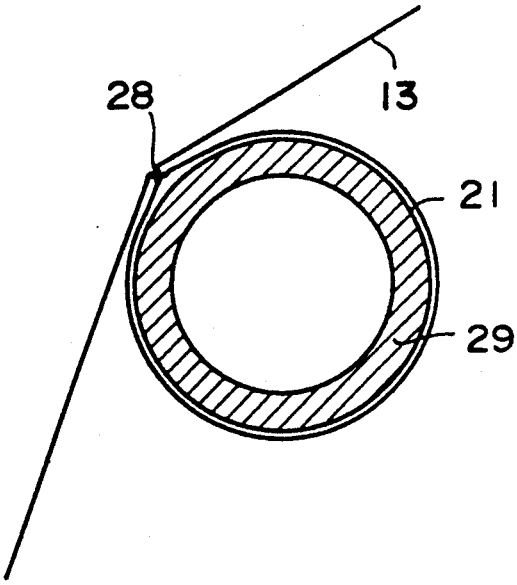
Fig. 6
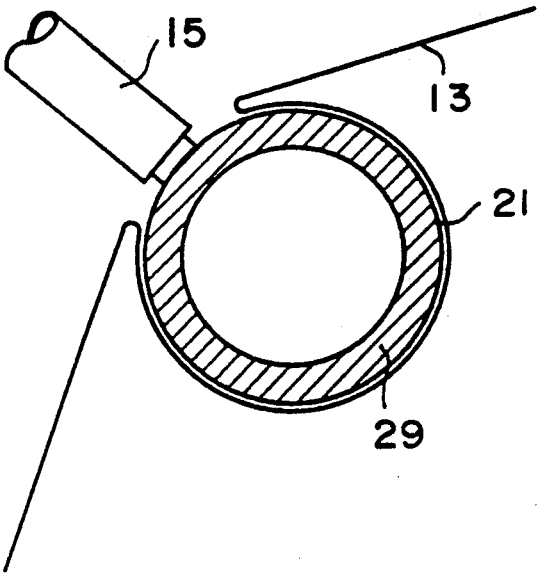
Fig. 7
Fig. 8
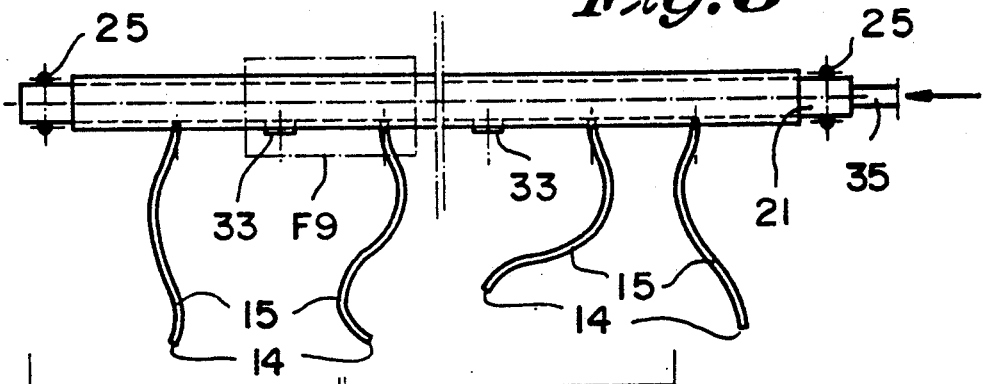
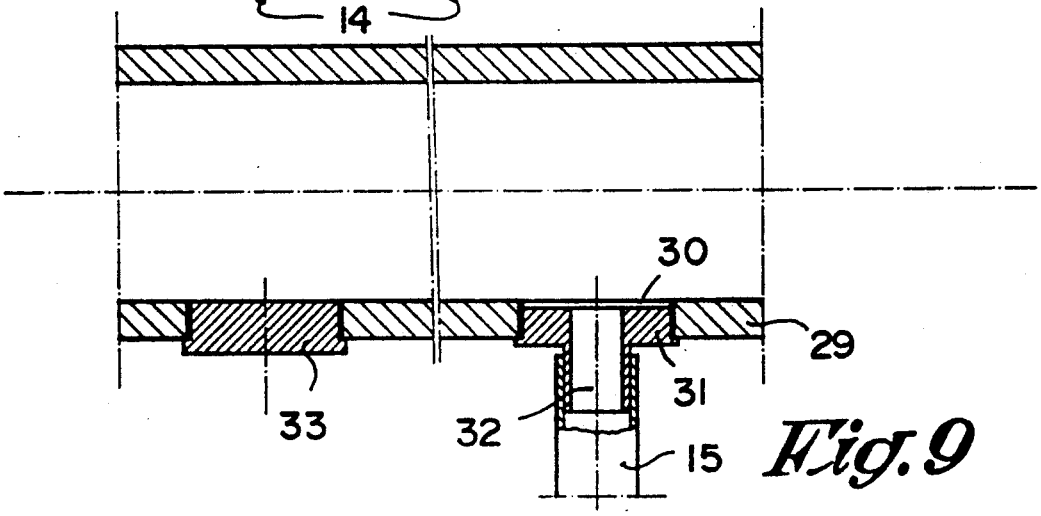
Fig. 9

DUST REMOVAL DEVICE IN WEAVING MACHINES

BACKGROUND OF THE INVENTION

1. Field of the Invention

This invention concerns a device for the removal of dust in weaving machines, more specifically a device designed to protect the parts of the weaving machine against weaving dust.

2. Description of Related Art

In the first instance, this device is meant to protect the warp beam from weaving dust which drops from the warp stop motion and the weaving frames. Indeed, friction caused by warp threads led through drop wires and the weaving frames generates a considerable amount of dust. It is a well-known fact that when this dust falls on the warp beam, it will be taken along by the warp threads, which will lead to a build up of dust concentrated on the drop wires. This will cause the formation of wads which may hamper the passage of warp threads being fed through the drop wires and may result in a breakdown of the weaving machine.

However, this device according to the invention may also be fitted at locations in the weaving machine other than in the vicinity of the warp beam.

In order to protect a warp beam from falling dust, a dust screen may be suspended between the weaving frames and the warp beam, e.g. as described in GB 199.544. The use of this dust screen has the disadvantage of collecting large amounts of dust, to such an extent that the dust screen has to be shaken off at regular intervals.

To circumvent this problem, a fixed partition may be fitted around the warp beam, above which blowers are fixedly mounted for blowing down the dust, e.g. as described in CH 490.549.

Such partitions, however, have the disadvantage of causing an obstruction when cleaning the machine, e.g. when warp beams are replaced, since removing such partitions is a lengthy process.

The possibility of combining traditional blowers with a dust screen is not the answer either, since fixed blowers have the disadvantage to tend to force the air in one direction, thus damaging the screen and allowing dust travel freely through the screen. The use of fixed blowers has the added disadvantage of partly blowing dust into the dust screen rather than removing it.

BRIEF SUMMARY OF THE INVENTION

The present invention concerns a device which does not share these disadvantages, i.e. which uses a dust screen which is easily removable and whereby dust is blown away without damaging the dust screen.

Such is the aim of the invention, a device for the removal of dust in weaving machines, more specifically to protect the parts of weaving machines from weaving dust, consisting of a combination of a dust screen, a number of freely movable tubes at one end which operate in combination with a side of the dust screen and blowing devices which feed air into the said tubes.

In this way, the tubes move freely from one side to the other at their unattached ends, allowing a highly effective cleaning process to take place behind the dust screen, without creating a uni-directional air flow. The dust blown loose will fall down and is collected preferably by a suction device.

It is advisable to fit the tubes in such a way as to leave free access to the weaving machine during a thorough cleaning session. One possibility would be to fit these tubes to a support bracket for the dust screen which spans the weaving width, whereby these tubes are mounted at regular intervals. When the dust screen is pushed aside, the support bracket, including the tubes fitted to it, can be removed without any difficulty.

A second possibility would be to fit these tubes to a movable device which, when activated, moves along the weaving width, whereby carriages may be used to locate fallen drop wires, e.g. a carriage as described in EP 234.630, EP 255.737 or EP 307.025.

In order to explain the characteristics of this invention, by way of example only, and without being limitative in any way, the following preferred embodiments are described with reference to the accompanying drawings, where:

DESCRIPTION OF THE DRAWINGS

FIG. 1 shows a weaving machine which has been equipped with a device in accordance with the invention;

FIG. 2 shows the part of FIG. 1 which is indicated with F2, to a greater scale;

FIG. 3 shows a cross-section according to line III—III in FIG. 2;

FIG. 4 shows a cross-section according to line IV—IV in FIG. 3;

FIG. 5 shows a view according to arrow F5 in FIG. 2;

FIGS. 6 to 8 show cross-sections, according to lines VI—VI, VII—VII and VIII—VIII in FIG. 5 respectively;

FIG. 9 shows a view of the part of FIG. 8 which is indicated with F9 to a greater scale and in crosssection;

DETAILED DESCRIPTION OF PREFERRED EMBODIMENTS

Figure 10:
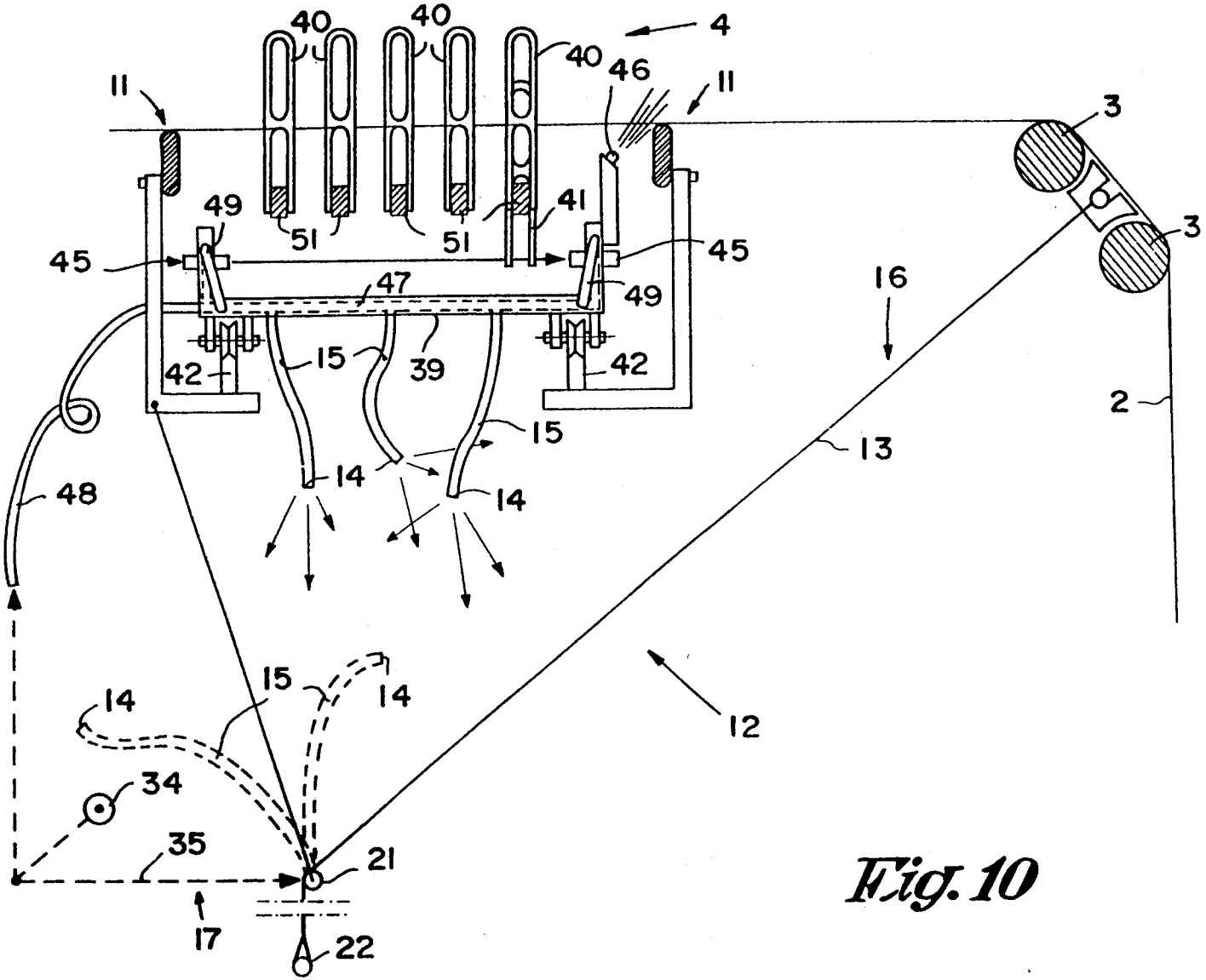
FIG. 10 shows a variant of the device in accordance with the invention.

FIG. 1 shows a schematic drawing of a weaving machine, the main parts of which are the warp beam (1), the warp (2), a number of back rests (3), the warp stop motion (4), the weaving frames (5), the sley (6) with the reed (7), the produced fabric (8), a number of driving and guide rolls (9), the cloth beam (10) and the frame (11).

The device (12), in accordance with the invention and the example given, provides in a screen for the warp beam (1) and allows dust to be removed from behind such screen. Needless to say, this device (12) can also be applied to other parts of the weaving machine.

As shown in FIGS. 1 and 2, the device (12), in accordance with the invention, mainly comprises a combination of a dust screen (13) which spans the entire weaving width, a number of freely movable tubes (15) at one end (14) which operate in combination with one side (16) of the dust screen (13) and which, more specifically, can move freely from one side to the other behind the dust screen (13), and blowing devices (17) which feed air into the tubes (15). Due to the force of the air blown through such tube ends (14), the tubes (15) move freely from one side to the other, thus blowing away dust in their vicinity in a very effective and very regular way, upon which the dust will fall down. The device will preferably include a suction device (18) which sucks in the falling dust, e.g. via a suction nozzle (19), upon which the dust is collected in a dust bag or receptacle (20). Dust can also be collected centrally in the weaving room.

The dust screen (13) is made of a fabric or foil which is dust-repulsive or anti-static material, thus preventing dust from adhering to the dust screen (13). Where the warp beam (1) is screened, the dust screen (13) will preferably be suspended from the back rests (3), will hang downwards at an acute angle stretching beyond the support bracket (21) and is held in a stretched position using a weight, such as a rod (22) which is attached to the bottom edge of the dust screen (13).

As shown in FIGS. 2 to 4, the top of the dust screen (13) is preferably sewn around a support covering the weaving width, such as a rod (23), which, in turn, is supported by a number of support brackets (24) which, for example, are clamped in between two back rests (3).

As shown in FIGS. 5 and 6, the aforementioned support bracket (21) will preferably also cover the entire weaving width, whereby the dust screen (13) is sewn around this support bracket (21) in a loop. The support bracket (21) is attached to the frame (11) of the weaving machine at its ends, preferably using flexible connections (25), such as cables. In order to adjust the height of the dust screen (13), the connection (25) will preferably be provided with lengthwise adjustment devices (26) which could be in a variety of shapes. In order to remove the dust screen (13) without any difficulty, the connections (25), preferably will be designed in such a way as to allow easy removal at at least one end. In the embodiment shown, the connections (25) have been attached at one end to the frame (11) by means of a hook (27).

The above tubes (15) have been positioned in such a way as to cover the largest possible area along the side (16) of the dust screen (13), thereby eliminating uncleaned areas. In the embodiment shown in FIGS. 1 to 9, they have been spread over the weaving width with this purpose in mind. As shown in FIG. 5, they have been fitted to the above support bracket (21).

As shown in FIG. 7, the seam (28) with which the dust screen (13) has been sewn around the support bracket (21) is interrupted where the tubes (15) have been fitted.

As illustrated in FIGS. 8 and 9, the support bracket (21) preferably comprises a pipe through which blowing air can be fed to the above tubes (15). The tubes (15) are attached to the wall (29) of the support bracket (21) transversely or radially, for example by means of fittings such as nipples (31) screwed into openings (30), over which the tubes (15) have been fastened and possibly glued to the same. The nipples (31) have a central orifice (32) to allow the passage of blowing air.

In the event of a number of openings (30) not being used, these may be sealed off using closures such as screw caps (33).

The above blowing devices (17), as shown in the embodiment, include a compressed air source (34) and a pipe which is at least partly made up of a flexible tube (35) connected to one end of the pipe-shaped support bracket (21).

As shown in FIG. 1, the air supply from the compressed air source (34) to the tubes (15) preferably will have a switch valve (37) controlled by a control unit (36). This switch valve will be opened at regular intervals, for example by means of a time switch which has been incorporated in the control unit (36).

The operation of the device can easily be deduced from FIG. 1 and consists in that at regular intervals and for a set period of time, air is fed to the tubes (15), by means of the switching of the switch valve (37) such that, for example, every 15 minutes, the valve will open for half a minute. This causes the ends (14) of the tubes (15) to move freely from one side to the other, thereby cleaning the area in the vicinity. The falling dust being collected in the suction nozzle (19).

The invention allows weaving dust to be removed from the dust screen (13), without damaging the screen (13) itself and is also extremely effective at removing dust from the cross beams (38) which connect both sides of the frame (11), as well as on the warp stop motion(4).

As an alternative design, the switch valve (37) is permanently open or such a switch valve (37) is not fitted at all.

Another alternative would be to fit the said tubes (15) to a movable device or tube carrier movable along the side (16) of the dust screen (13), which can move from one side to the other over the entire weaving width.

Figure 11:
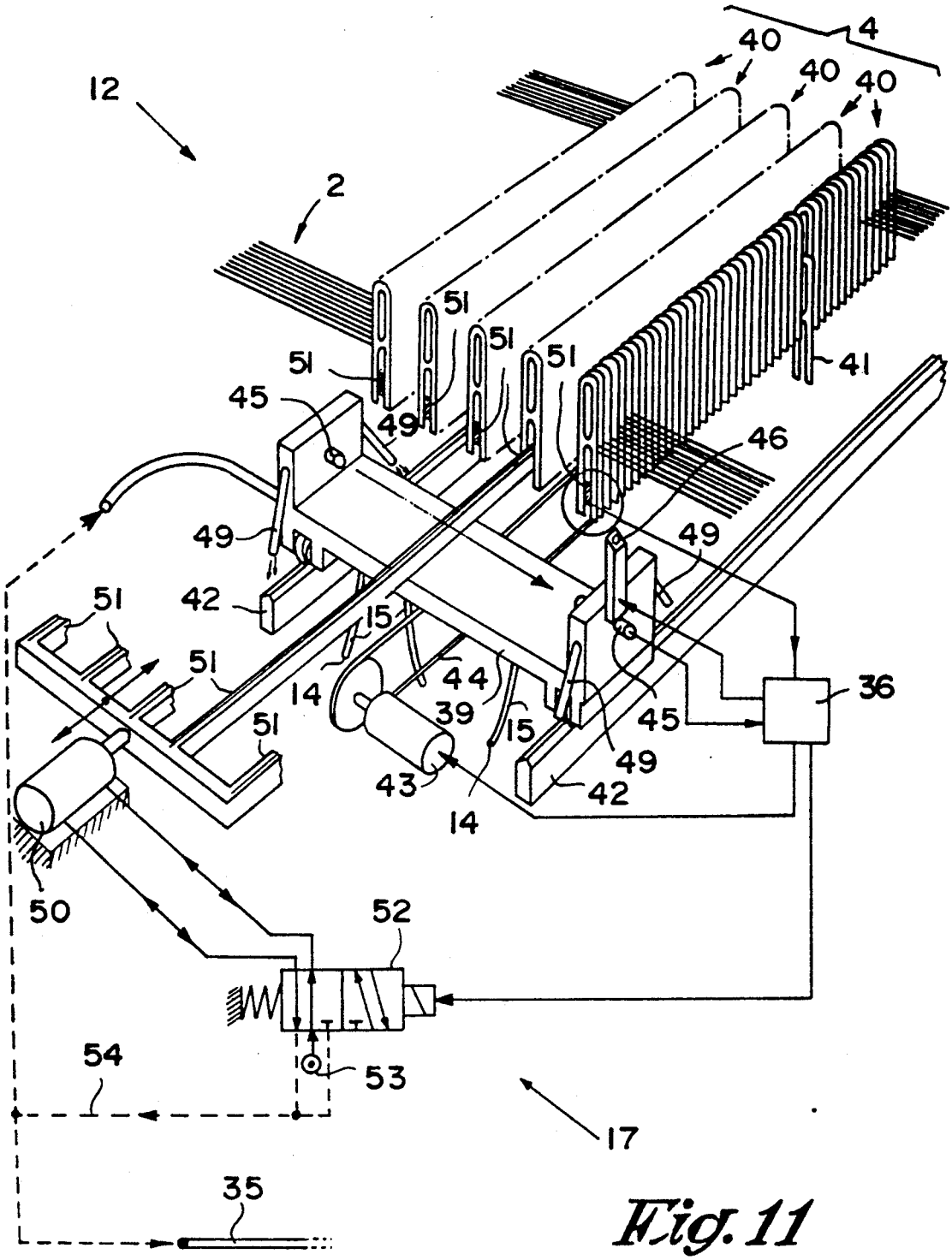
FIG. 11 shows part of the device, as shown in FIG. 10 in perspective.

FIGS. 10 and 11 illustrate this in an example, in which the movable device is formed of a carriage or slide (39) which can detect fallen drop wires (41) in the set of drop wires(40). Such carriages (39) have previously been described in the European patent applications No. 234.630, No. 255.737 and No. 307.025.

The carriage (39) runs, for example, on tracks (42) and is driven, for example, by a motor (43) which is controlled by the control unit (36) and a traction cable (44).

The carriage (39) is provided with an optical detection device (45) which, when the carriage (39) is set in motion, can locate a fallen drop wire (41), at which point the carriage is stopped and, for example, a warning lamp (46) is activated.

The remarkable thing about this invention is the fact that, underneath the carriage, a number of the said tubes (15) are fitted which, via a pipe (47) and a connection, similar to a flexible tube (48), are linked to the compressed air source (34).

Operation is clearly illustrated in FIGS. 10 and 11. Basically, the carriage (39) is moved over the weaving width, whilst the tubes (15) are fed with blowing air. As a result, the tubes (15) will move freely from one side to the other and thus clean the whole area, and the side (16) of the dust screen (13) in particular, extremely efficiently.

If required, a number of fixed blowers (49) may be fitted on the carriage (39), for example, so as to clean the tracks (42).

It goes without saying that, for the tubes (15) to move freely, other movable devices may be used, such as a carriage which is intended to pick up a fallen drop wire and move it above the warp stop motion (4). Alternatively, a carriage or similar may be introduced, the only purpose of which is to cause the tubes (15) to move.

The operation of the carriage (39) may be such that the blowing of the tubes (15) may be activated every time it is in motion, e.g. when searching a fallen drop wire (41). However, in order to not have to wait until the carriage (39) is moving as a result of a warp break, preferably, the control unit (36) will be equipped with a time switch, so that the carriage (39) can be moved, preferably, from one side to the other along the weaving width at a set interval, this only to allow cleaning activities to be carried out at regular intervals.

As shown in FIG. 10, the range of possibilities can include on the one hand a combination of tubes (15) attached to the carriage (39) or similar, and on the other hand tubes (15) fitted to the above support bracket (21).

The compressed air source (34) may be of any type. It may, for example, consist of a compressed air connection to an existing network, of a special compressor used to this end, or of a conduit system which supplies loss air. The latter is schematically shown in FIG. 11, whereby the waste or exhaust air from the cylinder (50) which moves the electrodes (51) of the warp stop motion (4) from side to side is used for feeding blowing air to the tubes (15).

The electrodes (51), as described in CH 430611 and U.S. Pat. No. 3,907,006, move to and fro over a short distance, for example by using the cylinder (50), which, via a pulse-controlled valve (52) is connected to a compressed air source (53). By moving the electrodes (51) to and fro dust is shaken from between the drop wires (40). The waste air, which is forced out of the non-active side of the piston of the cylinder (50), is fed through a pipe (54) to the flexible tube (48 and possibly to the flexible tube 35). Obviously, the to and fro motion of the electrodes (51) must coincide with the movement the carriage (39).

The said tubes (15) are made of an extremely flexible synthetic material, preferably 15 cm long with an internal diameter of 1 to 3 mm and preferably 1 mm.

As indicated on FIG. 1 with reference (55), the dust screen (13) can also be supported by the sides of the warp beam (1) using supports (56), which may be equipped with a number of tubes (15) each.

This invention is not just restricted to the embodiments shown in the diagrams. Indeed, this device for the removal of dust in weaving machines may be produced in different forms and dimensions, without stepping outside the limitations of the invention.

We claim:

1. A device for the removal of dust in weaving machines, in particular for protecting the parts of weaving machines from weaving dust, comprising a weaving machine, a dust screen; means for securing the dust screen to the weaving machine; a plurality of freely movable open-ended blowing tubes mounted on the weaving machine and arranged to direct air from their ends towards an area including an area adjacent a side of the dust screen; and air blowing means for supplying air through the tubes.

2. A device according to claim 1, including a suction means for collecting and removing dust blown away from the area of the screen by said tubes.

3. A device according to claim 1, wherein said tubes are spread out along the weaving width of said weaving machine.

4. A device according to claim 3, including support bracket means for suspending said dust screen, said support bracket means extending widthwise of the weaving machine.

5. A device according to claim 4, wherein said tubes extend transversely from said support bracket means.

6. A device according to claim 4, wherein said support bracket means includes tubular member; said tubular member including connecting fittings for the tubes at regular intervals; and a compressed air source connected to said tubular member for supplying air to the tubes through the tubular member.

7. A device according to claim 6, including fittings not connected to tubes and closures for unconnected fittings.

8. A device according to claim 4, wherein said support bracket means extends over the entire weaving width of the weaving machine; said dust screen is sewn as a seam around the support bracket means in a loop, said seam being interrupted at regular intervals; and fitting means extending through the seam interruptions for conveying air from the blowing means to the tubes.

9. A device according to claim 1, including a movable tube carrier means for moving the tubes along the dust screen over the entire weaving width of the weaving machine, said tubes supported for movement with said tube carrier means.

10. A device according to claim 9, said weaving machine including drop wires; and wherein the carrier means comprises a carriage for detecting fallen drop wires of the weaving machine.

11. A device according to claim 9, including a control unit for controlling the carriage at certain time intervals to move along the weaving width, said control unit including means for automatically feeding air to the tubes.

12. A device according to claim 11, wherein said air supply means includes means for supplying waste air from other parts of the weaving machine to the tubes.

13. A device according to claim 1, including a time switch means for enabling the air supply to the tubes at predetermined intervals.

14. A device according to claim 1 including a pair of parallel back rests; a pair of support brackets clamped between said back rests; a rod secured to said support brackets; said dust screen secured to said rod.

15. A device according to claim 1, said weaving machine including a warp beam; and wherein said dust screen is arranged to protect the warp beam from dust.

16. A device according to claim 1, said weaving machine including a frame means; a screen support bracket; a flexible connector means for attaching the screen support bracket to the frame means; at least a portion of said screen support bracket being connected to said frame by said flexible connector means.

17. A device according to claim 16, wherein the flexible connector means is elongated and is adjustable lengthwise.

18. A device according to claim 1 wherein the tubes have a length of approximately 15 cm.

19. A device according to claim 18 wherein said tubes have an internal diameter of 1 to 3 mm.

20. A device according to claim 19 wherein said tubes have an internal diameter of 1 mm.

21. A device according to claim 1 wherein the tubes are made of a flexible synthetic material.

22. A device according to claim 1 wherein the dust screen is made of a dust repulsive material.

23. A device according to claim 1 wherein the dust screen is made of an anti-static material.

24. A device according to claim 23, wherein one of said parts comprises a warp beam and said screen is arranged to shield the warp beam from weaving dust.

* * * * *